United States Patent [19]

Di Nunzio

[11] 4,333,578

[45] Jun. 8, 1982

[54] BOTTLE CAP HAVING OPENING MEANS

[76] Inventor: Giuseppe Di Nunzio, Via Filadelfia 130, 10137 Turin, Italy

[21] Appl. No.: 160,407

[22] Filed: Jun. 17, 1980

[30] Foreign Application Priority Data

Jun. 18, 1979 [IT] Italy ..... 53340/79[U]

[51] Int. Cl.[3] ..... B65D 41/32

[52] U.S. Cl. ..... 215/253; 215/317

[58] Field of Search ..... 215/250, 253, 317; 220/284

[56] References Cited

U.S. PATENT DOCUMENTS 2,942,747 6/1960 Towns ..... 215/253

*Primary Examiner*—George T. Hall

*Attorney, Agent, or Firm*—McGlew and Tuttle

[57] ABSTRACT

A bottle cap is provided with a circular inner peripheral relief member that is in opposition to a mating groove in the neck of the bottle. An annular collar is positioned beneath the relief member and is spaced from the neck of the bottle. A bottle opener is used to crack the annular collar to thereby indicate that the cap has been removed.

1 Claim, 3 Drawing Figures

BOTTLE CAP HAVING OPENING MEANS

FIELD OF THE INVENTION

The present invention relates generally to bottle caps and more particularly to bottle caps made from synthetic resin and which suitable for bottles containing mineral water, beer, sodas and the like.

BRIEF DESCRIPTION OF THE PRIOR ART

As is well known, bottles for mineral water, beer, sodas and the like are capped, after filling, by means of the conventional metal crown caps which are applied with the aid of special apparatus. Conventional metal caps besides insuring a hermetic sealing of the bottle, should also guarantee against the unauthorized removal of the bottled content.

It is, however, a fact that these conventional metallic crown caps may be readily removed from a bottle and re-applied with equal ease without the slightest sign of tampering. Purity and authenticity of product are thus jeopardized to the annoyance of the buyer of user.

Caps may be readily removed either by covering the outer surface with a coin and then opening the bottle with a bottle opener, or, as more recently experienced, caps may be opened by simple application of pressure and torque, simultaneously, by means of one's hand.

Furthermore, metallic crown caps are subject to rust attack along the perimeter of the crown that has been produced by the culturing operation and adjoining the ribbing defined by the crowning operation.

Finally, a metallic crown cap when removed from a bottle without the precaution of employing metallic disc or coin, as mentioned above, cannot be re-used as a normal cap without loss of carbination of the contents, which consequently has to be discarded because it has turned flat.

SUMMARY OF THE INVENTION

It is therefore an object of the present invention to eliminate the above mentioned drawbacks and to provide a bottle cap of synthetic resin suitable particularly for mineral water, beer, sodas and the like, the essential feature of which cap resides in that, beneath the circular, peripheral relief that snap-engager and seals the bottle, there is an annular collar which in use is positioned concentrically to the axis of the bottle and slightly spaced from the neck of the bottle so that when acting as a lever against the cap itself, with a bottle cap, the cap may be removed from the bottle while at the same time the collar remains damaged and is clearly indicating that a tampering action has taken place.

DESCRIPTION OF THE DRAWINGS

The present invention will be better understood from the following detailed description thereof and with reference to the accompanying drawings which are merely illustrative of an embodiment of the invention and not limitative thereof, and in which.

DETAILED DESCRIPTION OF THE INVENTION

Figure 1:
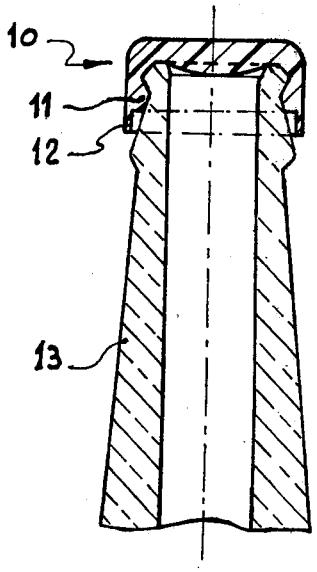
FIG. 1 is an elevation view, vertically-sectioned, of the bottle cap of the invention.

Referring now to the accompanying drawings, numeral 10 indicates a bottle cap of synthetic resin. Cap 10 has a circular peripheral inner relief 11 which serves to snap in position and to hold the relief 11 in a corresponding circular groove provided in the neck of the bottle 13. This snapping action seals the bottle. An annular collar 12 is also provided on the cap 10 at its lowermost circular extremity and is slightly spaced from the neck of the bottle (see FIG. 1).

Figure 2:
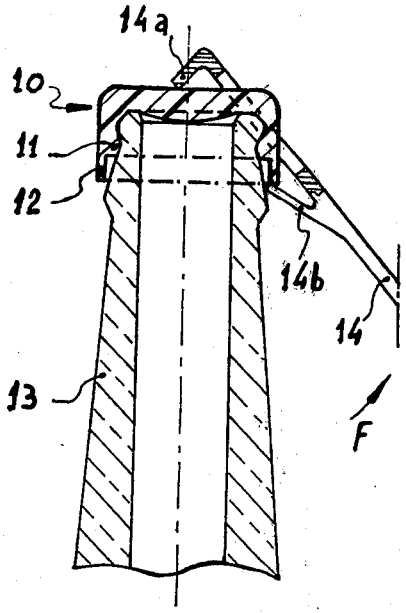
FIG. 2 is a similar view, in which a bottle opener is shown in position of removal of the cap.
Figure 3:
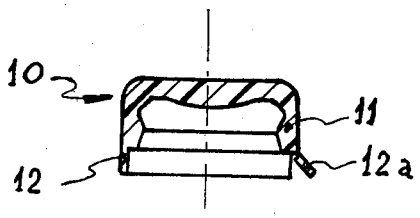
FIG. 3 is a vertical sectional view of the cap of the invention after removal from a bottle.

Bottle cap 10 is applied through the exertion of the necessary pressure which is possible because of the elastic property processed by the synthetic resin. The cap will then snap into sealing position around the neck of the bottle. When the cap is to be removed from the bottle 13, it is sufficient to apply the lever action of a common bottle opener 14 as clearly illustrated in FIG. 2.

The bottle opener 14 is positioned in such a manner that its upper extremity 14*a* engages the upper outer surface of cap 10 and its grasping member 14*b* engages between the collar 12 and the neck of the bottle 13. Acting then upon the bottle opener 14 in the direction of arrow F, the cap 10 may be removed from the bottle with the same degree of ease as in the case of conventional crowned metal caps. During removal of the cap 10, the grasping member 14*b* of the bottle opener 14 will cause visible cracks and dents 12*a* in the annular collar 12 of the cap. These dents or cracks 12*a* will be so evident and visible as to clearly indicate any tampering with the bottle.

The user, after removing the cap from the bottle, if desirous of re-using the cap as a sealant for the content of the bottle, will be in a position to re-apply the cap by the application of the required hand pressure upon the upper surface of the cap, thus causing the snap-closing of the cap around the neck of the bottle.

Furthermore, due to the nature of the cap, oxidation (rust) is totally eliminated, thus adding another advantage of the cap of the invention to those previously mentioned.

What I claim is:

1. Bottle cap of synthetic resin material suitable for carbonated beverages which comprises a continuous peripheral relief member that is directed radially inwardly and which is substantially V-shaped in cross-section, said relief member being in juxtaposition with a mating groove in the neck of the bottle and beneath said member (11) a continuous, annular collar (12) spaced radially outwardly from the neck of the bottle and forming the lowermost portion of said bottle cap; said annular collar being subject to cracking during the removal of said cap from said bottle by the action of a bottle opener, thereby providing indication of previous removal of said cap.

* * * * *